US010702001B2

(12) United States Patent
Morgan et al.

(10) Patent No.: US 10,702,001 B2
(45) Date of Patent: Jul. 7, 2020

(54) HELMET INCLUDING MAGNETIC SUSPENSION SYSTEM

(71) Applicant: Tate Technology, LLC, Pacific Palisades, CA (US)

(72) Inventors: Gerard Eric Morgan, Orangeburg, SC (US); Gerard Earl Morgan, III, Sprague River, OR (US)

(73) Assignee: TATE TECHNOLOGY, LLC, Pacific Palisades, CA (US)

( * ) Notice: Subject to any disclaimer, the term of this patent is extended or adjusted under 35 U.S.C. 154(b) by 161 days.

(21) Appl. No.: 15/783,968

(22) Filed: Oct. 13, 2017

(65) Prior Publication Data

US 2018/0110281 A1 Apr. 26, 2018

Related U.S. Application Data

(60) Provisional application No. 62/410,745, filed on Oct. 20, 2016.

(51) Int. Cl.

| | |
|---|---|
| ***A42B 3/06*** | (2006.01) |
| ***H01F 7/02*** | (2006.01) |
| ***A42B 3/12*** | (2006.01) |
| ***A42C 2/00*** | (2006.01) |

(52) U.S. Cl.

CPC ..... *A42B 3/064* (2013.01); *A42B 3/125* (2013.01); *A42C 2/00* (2013.01); *H01F 7/021* (2013.01); *H01F 7/0236* (2013.01)

(58) Field of Classification Search

CPC ..... A42B 3/064; A42B 3/063; A42B 3/06; A42C 2/00; A41D 13/015; H01F 7/021; H01F 7/0236

USPC ..... 2/141, 411

See application file for complete search history.

(56) References Cited

U.S. PATENT DOCUMENTS

| | | | | |
|---|---|---|---|---|
| 4,307,471 | A * | 12/1981 | Lovell | A42B 3/065 2/411 |
| 5,204,998 | A * | 4/1993 | Liu | F16F 1/3732 2/411 |
| 5,871,438 | A * | 2/1999 | Ardizzone | A61N 2/06 600/15 |
| 6,658,671 | B1 * | 12/2003 | Von Holst | A42B 3/064 2/412 |
| 8,863,319 | B2 * | 10/2014 | Knight | A42B 3/064 2/411 |
| 9,388,873 | B1 * | 7/2016 | Phipps | B60R 19/28 |
| 9,687,037 | B1 * | 6/2017 | Colello | A42B 3/069 |
| 9,750,297 | B1 * | 9/2017 | Mini Townson | A42B 3/14 |
| 10,034,511 | B1 * | 7/2018 | Bulat | A63B 71/10 |
| 2008/0246573 | A1 * | 10/2008 | Souder | H01F 7/0294 335/306 |
| 2010/0275347 | A1 * | 11/2010 | Baldackin | A42B 3/065 2/411 |

(Continued)

*Primary Examiner* — Heather N Mangine

(74) *Attorney, Agent, or Firm* — Jeffer Mangels; Butler & Mitchell LLP; Brennan C. Swain, Esq.

(57) ABSTRACT

A helmet that includes an outer shell having at least a first outer magnetic member, an inner shell having at least a first inner magnetic member, and padding secured inside the inner shell. The first inner magnetic member is spaced from and opposed to the first outer magnetic member, such that the first inner magnetic member repels the first outer magnetic member. The outer shell is connected to the inner shell.

13 Claims, 10 Drawing Sheets

(56) References Cited

U.S. PATENT DOCUMENTS

| | | | | |
|---|---|---|---|---|
| 2012/0186003 | A1* | 7/2012 | Heger | A41D 13/015 2/412 |
| 2012/0256715 | A1* | 10/2012 | Fullerton | H01F 7/021 335/285 |
| 2012/0262019 | A1* | 10/2012 | Smith | H02K 1/2766 310/156.07 |
| 2013/0042397 | A1* | 2/2013 | Halldin | A42B 3/064 2/411 |
| 2014/0215693 | A1* | 8/2014 | O'Gara | A42B 3/0406 2/410 |
| 2014/0259308 | A1* | 9/2014 | Moss | A42B 3/0406 2/410 |
| 2015/0089722 | A1* | 4/2015 | Berry | A42B 3/064 2/412 |
| 2015/0216247 | A1* | 8/2015 | Price | A42B 3/125 2/414 |
| 2016/0073723 | A1* | 3/2016 | Halldin | A42B 3/06 2/411 |
| 2017/0360122 | A1* | 12/2017 | Chin | A41D 1/002 |
| 2018/0145548 | A1* | 5/2018 | Hashimoto | H02K 1/17 |
| 2019/0159541 | A1* | 5/2019 | Valentino, Sr. | A42B 3/064 |

* cited by examiner

HELMET INCLUDING MAGNETIC SUSPENSION SYSTEM

CROSS REFERENCE TO RELATED APPLICATIONS

This application claims the benefit of U.S. Provisional Application No. 62/410,745, filed Oct. 20, 2016, the entirety of which is incorporated by reference herein.

FIELD OF THE INVENTION

The present invention relates generally to a helmet with opposing magnetic forces positioned in a helmet protection system designed to help protect the human head from injury resulting from sports and other impacts.

BACKGROUND OF THE INVENTION

Helmets in sports, military and law enforcement are generally composed of an outer shell and an inner liner. Depending on the intended use (impact vs. ballistic) the shell can be made of a thermoplastic, ABS, polycarbonate, carbon fiber, Kevlar, or any number of other materials known to those skilled in the art. Liners evolved from a simple strap or web suspension system meant to separate the wearer's head from the shell to designs utilizing fluid displacement, air, and/or crushable foam in one or more layers tailored to respond to varying impact strengths.

With respect to head impacts and trauma, the most common injuries result from direct impacts resulting in linear acceleration of the head, and tangential blows resulting in angular or rotational acceleration. The energy transfer from a direct impact may result in either or both linear and rotational acceleration of the brain inside the skull. The consistency of brain material is similar to gelatin and once accelerated inside the skull the brain impacts the side of the skull opposite the impact. The point of impact is called the "coup," and the "slap" injury from the brain impacting the opposite side of the skull is called the "contra-coup injury." Bleeding and tissue damage frequently occur at both sides with adequate trauma. Furthermore, the inner surface of the skull has many depressions and ridges of bone. Some areas are particularly rough, and as the brain travels over these surfaces additional damage and bleeding can occur. Underdeveloped brains of adolescents incur damages that may not show up until later in adulthood. The human brain does not fully develop until well in the 20's.

Tangential impacts impart a rotational acceleration to the brain. Different types of brain material have slightly different density, and as such experience greater or lesser rotational momentum under such circumstances. This difference in momentum results in shear forces that tear the brain matter, and more specifically, axons. In severe cases, this results in diffuse axonal injury. Shear injuries are also common at points of relative attachment/securement or immobility within the brain, such as the corpus callosum.

Varying degrees of these patterns of injury account for the dramatic number of concussive and sub concussive injuries observed in professional, collegiate, and youth sports. These injuries can result in life-threatening consequences; however, more frequently result in residual cognitive and behavior deficits. Ongoing exposure can result in temporary loss of brain function leading to cognitive, physical and emotional symptoms, such as confusion, vomiting, headache, nausea, depression, disturbed sleep, moodiness, and amnesia leading to Chronic Traumatic Encephalopathy ("CTE"), a neurodegenerative condition with similarities to Alzheimer's Disease.

To this point, the helmet shell has done little more than prevent penetrating trauma and skull fractures, which is what it was originally designed for and continues to perform. Much work has been performed on the liner systems to attempt to mitigate energy transfer to the wearer. Current liner systems employed have a maximal extent of compressibility after which their ability to mitigate energy transfer is markedly diminished. These liner systems are best suited to direct impacts where the compressibility of the foam or fluid systems mitigates a portion of the energy transfer to the wearer. However, in the setting of more tangential impacts resulting in rotational acceleration, these methods offer little to prevent injury. At the time of impact the shell experiences an immediate rotational acceleration, which is directly imparted to the liner system, as they are mechanically connected. Current liner systems are optimally suited to dissipate energy in a plane perpendicular to the shell and liner surface offering little in the form of energy dissipation and attenuation prior to rotational energy transfer to the wearer.

SUMMARY OF THE PREFERRED EMBODIMENTS

In accordance with a first aspect of the present invention there is provided a helmet that includes an outer shell having at least a first outer magnetic member, an inner shell having at least a first inner magnetic member, and padding secured inside the inner shell. The first inner magnetic member is spaced from and opposed to the first outer magnetic member, such that the first inner magnetic member repels the first outer magnetic member. The outer shell is connected to the inner shell. In a preferred embodiment, the first outer magnetic member is bonded to an inner surface of the outer shell and the first inner magnetic member is bonded to an outer surface of the inner shell.

In a preferred embodiment, the first outer magnetic member is embedded in the outer shell and the first inner magnetic member is embedded in the inner shell. In a preferred embodiment, the first outer magnetic member is received in a recess defined in an inner surface of the outer shell, and wherein the first inner magnetic member is received in a recess defined in an outer surface of the inner shell. In another preferred embodiment, the first outer magnetic member comprises a powder and the first inner magnetic member comprises a powder. In another preferred embodiment, at least one of the first outer magnetic member and the first inner magnetic member comprises a powder.

In a preferred embodiment, the inner shell is connected to the outer shell by at least a first connection member. Preferably, the first connection member is made of an elastic material, such that the outer shell can move with respect to the inner shell. In a preferred embodiment, the outer shell includes a plurality of outer magnetic members and the an inner shell includes a plurality of inner magnetic members. The inner magnetic members are spaced from the outer magnetic members and at least some of the inner magnetic members oppose at least some of the outer magnetic members, such that the inner magnetic members repel the outer magnetic members. Preferably, one of the inner shell or the outer shell includes a set of magnetic members that oppose either the first inner magnetic member or the first outer magnetic member. Preferably, the set of magnetic members includes a central magnetic member and a plurality of surrounding magnetic members that surround the central magnetic member and the central magnetic member opposes and is co-axial with either the first inner magnetic member (when the set is on the outer shell) or the first outer magnetic member (when the set is on the inner shell). In a preferred embodiment, the surrounding magnetic members have a stronger magnetism than the central magnetic member. In a preferred embodiment, the surrounding magnetic members are not opposed to any magnetic members (on the opposite shell). In a preferred embodiment, one or both of the first outer magnetic member and the first inner magnetic member are electromagnets.

In accordance with another aspect of the present invention there is provided a method of creating a helmet that includes providing a curved outer shell that comprises a first outer magnetic member, and securing a first inner magnetic member in a position such that it is spaced from the first outer magnetic member. The first inner magnetic member opposes and repels the first outer magnetic member. In a preferred embodiment, the method also includes securing padding within the helmet. The first inner magnetic member is positioned between the padding and the first outer magnetic member. Preferably, one of the first inner magnetic member or the first outer magnetic member is a central magnetic member that is surrounded by a plurality of surrounding magnetic members.

In a preferred embodiment, the helmet includes an inner shell that comprises the first inner magnetic member and the method further includes securing the inner shell to the outer shell with a first connection member. Preferably, the first connection member comprises an elastic material, such that the outer shell can move with respect to the inner shell.

The present invention relates to protective gear for sports, military, law enforcement, construction, and more specifically, but not limited to, the helmet. In the drawings the helmet is shown as a football helmet. However, this is only exemplary and any type of helmet is within the scope of the present invention. In a preferred embodiment, the invention includes an outer shell and an inner shell. Preferably, both the inner and outer shell are magnetic in nature or are permanently affixed to magnetic material with the magnetic vectors of both the inner and outer shell oriented such that they are in continual magnetic opposition. The outer shell and inner shell can be formed from high field strength bonded magnets, blended magnetic powder, attached to permanently affixed bonded magnetic plates, preformed commercially available isotropic or anisotropic magnets, electromagnets, or a combination of the above and are collectively designed to be situated in continuous magnetic opposition.

The inventive system is dynamic, providing variable levels of impact resistance proportionate with the impact force. Magnetic resistance is well suited to the system requirements. Magnets positioned such that opposed faces brought in close proximity experience increasing resistance the shorter the distance following the inverse square law. Depending on the flux strength of the magnets, the opposing magnetic force can be overcome with enough supplied force; however, significant energy will be expended in bringing these two faces together. Bringing two opposed magnetic faces directly together is difficult as the flux lines create significant laterally directed forces.

Current helmet designs have the liner system directly attached to the shell. This results in direct energy transfer to the wearer at the point of impact minus the impact mitigating effect of the liner system. The present invention using an opposing magnetic outer shell and inner liner system would spread the impact over a larger area. Attachment or securement of the liner to the helmet shell is also detrimental for glancing or tangential blows, which result in rotational acceleration. As the liner and helmet shell are in contact they move in unison providing little benefit in rotational acceleration mitigation. The present invention employs an opposing magnetic shell and magnetic inner liner or shell system that disconnects the shell from the opposing magnetic inner liner or shell such that there is some free movement in the plane parallel with the helmet liner interface. A magnetically suspended liner system at least partially suspends the liner system from the helmet shell, and thereby provides a mechanism for energy dispersion from tangential, or non-linear blows, and linear blows. In the present invention, where the helmet is fabricated using bonded magnets for the inner liner or shell and outer shell, the opposing inner liner or shell and outer shell are attached at the periphery utilizing an elastic medium such that rotational forces are also dissipated in the elastic medium. This point of attachment/securement also keeps the shell and liner in alignment. Such a viscoelastic point of attachment/securement is also envisioned for other interactions of this technology.

The opposing magnetic suspension system of the present invention provides an ideal auto adjusting liner system insuring maximal uniform contact of the magnetic liner system or inner shell in relationship to the magnetized outer helmet shell, as well as to the wearer's head. The liner shell is in constant opposition to the outer shell, or vice versa, the shell is in constant opposition to the magnetized inner liner system. In a preferred embodiment, the present invention also incorporates a liner shell where rather than being constructed as a solid shell, the inner shell is fabricated with interdigitating elements having some movement in the plane parallel with the shell. This allows the inner shell to expand and contract when the wearer puts on/dons or removes the helmet. When the wearer dons the helmet, the head pushes the liner toward the shell providing uniform and symmetric contact of the wearer's head and the liner system. The geometry of the magnetic fields and/or the peripheral securement ensures proper alignment of the liner and shell. The present invention therefore assures the proper contact of the wearer's head with the liner pads.

It will be appreciated by those of ordinary skill in the art that the present invention utilizes opposing magnetic forces positioned between the outer helmet shell and the inner liner shell in a geometric or non-geometric opposing magnetic pattern creating a magnetic suspension system such that the helmet shell perpetually and continuously floats over the liner or inner shell. Opposing magnetic forces mitigate impact forces both from direct impacts resulting in linear acceleration and tangential impacts resulting in rotational acceleration. As magnetic field forces are proportional to the inverse square of the distance separating the two opposing faces, this design can respond to a wide range of forces up to the force required to bring the opposing magnetic faces in direct contact.

In an exemplary embodiment, the magnetic materials used can include neodymium iron boron (NdFeB), samarium cobalt (SmCo), aluminum nickel cobalt (AlNiCo), ceramic, magnetized powder, bonded or supermagnets. However, any magnetic material can be used in the present invention. To maximize field strength and minimize weight, NdFeB permanent magnets or NdFeB bonded magnets are preferred for the present invention. In a preferred embodiment, the magnets are substantially disk shaped and magnetized through the thickness. Other shapes are possible including: arc, ring, square, ball, cup, wedge, triangle, pyramidal, conical or other geometric shape or combination of geometric shapes. NdFeB magnets are very powerful with N50 BrMax measuring 14,500 gauss. Magnet material, strength, size, thickness, and geometry can be tailored for each intended utilization by those skilled in the art of the present invention. The present invention is inclusive of all materials, size, geometry, and shape, known or unknown, as it pertains to utilization for magnetic suspension systems in protective equipment. Alternatively, for ease of manufacturing, the helmet shell and the inner opposing magnetic liner or magnetic inner shell system can be formed from bonded magnetic materials, as defined above. Once formed, the bonded magnet shell and inner opposing magnetic liner or magnetic inner shell system can be magnetized such that they are in opposition. Alternatively, bonded magnetic plates or an additional shell conforming to the inner surface of the outer shell can be manufactured separately and subsequently secured to the inner surface of the outer shell. Current technology allows for high field strength bonded magnets compatible with injection molding technology, as known to those skilled in the prior art. Current technology also allows for a blended magnetic shell material composition.

In the preferred embodiment of the present invention where permanent magnets are utilized, shell-sided magnets are permanently attached to the helmet shell, preferably in receiving grooves formed during helmet shell fabrication. In another embodiment, the magnets can be removable such that the dynamics between the outer magnets and the inner magnets can be changed. Any number of adhesives or other retaining devices for securing the magnets in place can be utilized by those skilled in the prior art. Alternatively, the magnets can be formed into the shell during shell fabrication. For thermoplastic fabrication this may require usage of magnetic material with a higher working temperature such as AlNiCo or SmCo. Alternatively, the magnets can be arranged separately in a medium of rubber or thermoplastic in a shape(s) including, but not limited to round or circular, square, rectangular, hexagonal, bonded, texturized, an arranged rosette pattern that conform(s) perfectly with the inner surface of the shell, which is subsequently attached to the helmet shell using, but not limited to an adhesive, ultrasonic welding, or other mechanism known to those skilled in the art. Alternatively, magnet material can be mixed in with a thermoplastic polymer, and more, prior to shell creation. The helmet shell can subsequently be magnetized, such that the correct magnetic geometry is created and the helmet shell itself becomes a bonded magnet.

In a preferred embodiment, the helmet outer shell-sided magnets are configured in circular pattern or rosettes or cups. Furthermore, the diameter of the inner magnets can be larger than the diameter of the outer shell magnets or vice versa. This size difference controls the amount of lateral mobility of the outer shell with respect to the opposing magnetic liner system or inner shell. These shapes, rosettes or cups constitute the magnetic walls of the present invention. In a preferred embodiment, the magnetic vector of the shapes and/or rosette is substantially perpendicular to the helmet shell and opposing magnetic liner surfaces. Optimally, the shape or rosette magnets should be sufficiently close such that there is substantial interaction of their flux fields. The inner surface of the helmet shell may have a maximum number of shape and/or rosettes or cups based upon the available space. Centered within the rosette is a smaller or weaker disk shaped magnet (or bottom of the cup), which is either thinner or of lower magnetic field strength than the surrounding containment magnets. The magnetic orientation of the central shape and/or rosette magnet or bottom of the cup is substantially parallel with the surrounding rosette magnet and is in opposition to the liner-sided magnet, and the magnetic vector is substantially perpendicular to the shell and liner surfaces. The stronger shape and/or rosette helps keep the liner or inner magnet centered over the smaller central rosette or outer magnet. This outer magnet and its opposing force against the liner or inner magnet determines the energy necessary to, "bottom out" the magnetic suspension during a direct impact and are sized appropriately.

In a preferred embodiment, the liner-sided magnet is disc or hemisphere shaped and magnetized through the thickness oriented such that the magnetic orientation is in opposition to the rosette and central rosette magnets or cup of the shell. The inner magnets are substantially parallel to the outer magnets and the magnetic vector is substantially perpendicular to the outer helmet shell and inner opposing magnetic liner surfaces. In a preferred embodiment, the outer diameter is smaller than the inner diameter of the shape and/or rosette or cup, such that the liner magnet sits in the magnetic well created by the rosette or cup configuration. The liner-sided magnets can be permanently secured to the liner by means of an adhesive, thermoplastic receiving channel, or other means known to those skilled in the prior art.

While the outer helmet shell is perpetually levitated/floating above the inner liner or inner shell around the helmet surface, mechanically decoupling the shell from the liner, the liner movement must be restricted at the margins or edges of the helmet to prevent expulsion of the liner due to opposing magnetic forces. This also serves to keep the inner and outer shells in proper alignment. Preferably, there is a narrow channel around the periphery of the helmet shell that the opposing magnetic liner system fits into, but is not attached to. This provides adequate restriction of liner movement while minimizing mechanical attachment/securement to the shell. Alternatively, the helmet shell and the opposing magnetic liner can be attached at the margins with a material that allows the outer shell to move with respect to the inner shell, such as an elastic material, elastomeric material, viscoelastic polymer or the like that aids in energy dissipation in the event of rotational impacts.

Liner-sided permanent magnets can be secured to the inner shell, preferably in a receiving notch, hole or groove whether the liner shell is fabricated as a rigid shell or an interlocking adjustable configuration. In other words, the inner shell is not necessarily made of a rigid material, but may be a net or any other material that holds the inner magnets in place. Regardless of the material used, the liner-sided magnets can be permanently attached with stable geometric orientation. Liner systems utilizing air inflation mechanisms scan also be used in the helmet of the present invention.

Alternatively, the inner shell and associated liner magnets can be completely separate from the helmet shell. The wearer first puts on the liner or inner shell and then separately puts on the helmet shell. The liner or inner shell is then quickly attached at predetermined points around the periphery with a quick attach and detach system, such as, but limited to hook and loop material, snaps, buttons, latches, letters or other mechanism known to those skilled in the art. The liner or inner shell may be a solid shell, or may be an automatically self-adjusting inner shell comprised of interlocking pieces that expands and contracts upon the wearer's head.

In another preferred embodiment, or in conjunction with the other embodiments of the present invention, electromagnetic coils embedded in or attached to the outer shell and inner shell further enhance energy attenuation. Electromagnets have the benefit of adjustable magnetic force and can be driven by onboard electronics responding to real-time acceleration data. A preferred embodiment combines the previously described utilization of permanent or bonded magnets in both the outer shell and inner liner or inner shell augmented with electromagnets in the liner or inner shell. Ideally, the electromagnets are only utilized when the onboard sensing system detects an impact above a predetermined threshold, such as 30G. The system then activates the electromagnets with the magnetic vector in opposition to the outer shell magnetic vector, tuning the applied force to best mitigate the impact force. This requires an onboard battery or other electrical source and an accompanying electronics package and accelerometer sensor system. During the smaller blows, which are otherwise mitigated by the permanent or regular magnets and liner magnetic opposition, the electromagnets create current, which can be tapped to charge the battery and power any other onboard electronic packages. The inner shell can also include electromagnets. Electromagnetic shielding can be used to protect the wearer.

This invention optimally utilizes a chin strap or other fixation device to insure adequate orientation and opposition of the outer shell and inner shell with their associated opposed magnetic vectors.

It will be appreciated by those of ordinary skill in the art that while magnetic fields cannot be blocked, there are strategies to redirect magnetic flux lines typically using ferromagnetic materials. Utilizing these materials in the shell would limit the extent and magnitude of fringe fields.

The present invention is a magnetic suspension system, and energy dissipation in protective gear system and apparatus that is designed to protect the head from injury resulting from sports and other impacts. A magnetic suspension and energy dissipation in protective gear system and apparatus in the form of an outer shell and inner liner or shell system comprised of directly opposing magnetic suspension forces in a liner system covering the head within a helmet system including the front, side(s), crown, and rear of the head area, made of an outer shell and an inner liner, and secured to the inner shell is a geometric arrangement of permanent magnets, with magnetic walls and wells with the liner that is also fit with magnets on the shell facing surface such that the magnetic orientation of the shell and liner magnets are opposing, including the liner magnets that are also geometrically arranged, so the magnets are optimally positioned such that they align with the magnetic wells in the shell magnetic arrangement, including that this configuration provides magnetic suspension of the inner liner or shell system while keeping the inner liner system bound in the magnetic wells created through geometrically positioned shell side magnets, and including that the outer shell and inner shell may be formed from high field strength bonded magnets and are subsequently magnetized after fabrication such that the inner and outer shell are both in magnetic opposition for protection.

In a preferred embodiment, the present invention includes an outer shell with a plurality of outer shell magnets either permanently secured to the inner surface of the outer shell, or embedded in the outer shell such that all of their magnetic vectors are uniformly oriented, or a plurality of magnetic powder and current helmet shell materials combined. A separate inner shell includes a plurality of permanently affixed magnets geometrically positioned along the outer surface of the inner shell such that their magnetic orientation is uniform and in magnetic opposition to the plurality of magnets along the inner surface of the outer shell, or a plurality of magnetic powder and current helmet shell materials combined. The resultant opposing magnetic forces serve to separate, or levitate the outer shell with respect to the inner liner or shell. Secured to the inner surface of the inner shell is a liner padding system, typically made of one or more layers of foam, as known to those familiar in the art. This could be any of a number of currently available helmet liner systems. In use, the inner liner padding system is in contact with the wearer's head.

The invention also includes variations in magnetic geometry to attain the desired levitation effect, as well as a method for peripheral securement of the inner and outer shells, as well as a method for a combination of permanent and adjustable electromagnetic repulsion, and a method for automatic adjustment of the inner shell such that the inner liner padding system is automatically contoured around the wearer's head, such that the liner padding is in good contact with the wearer.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
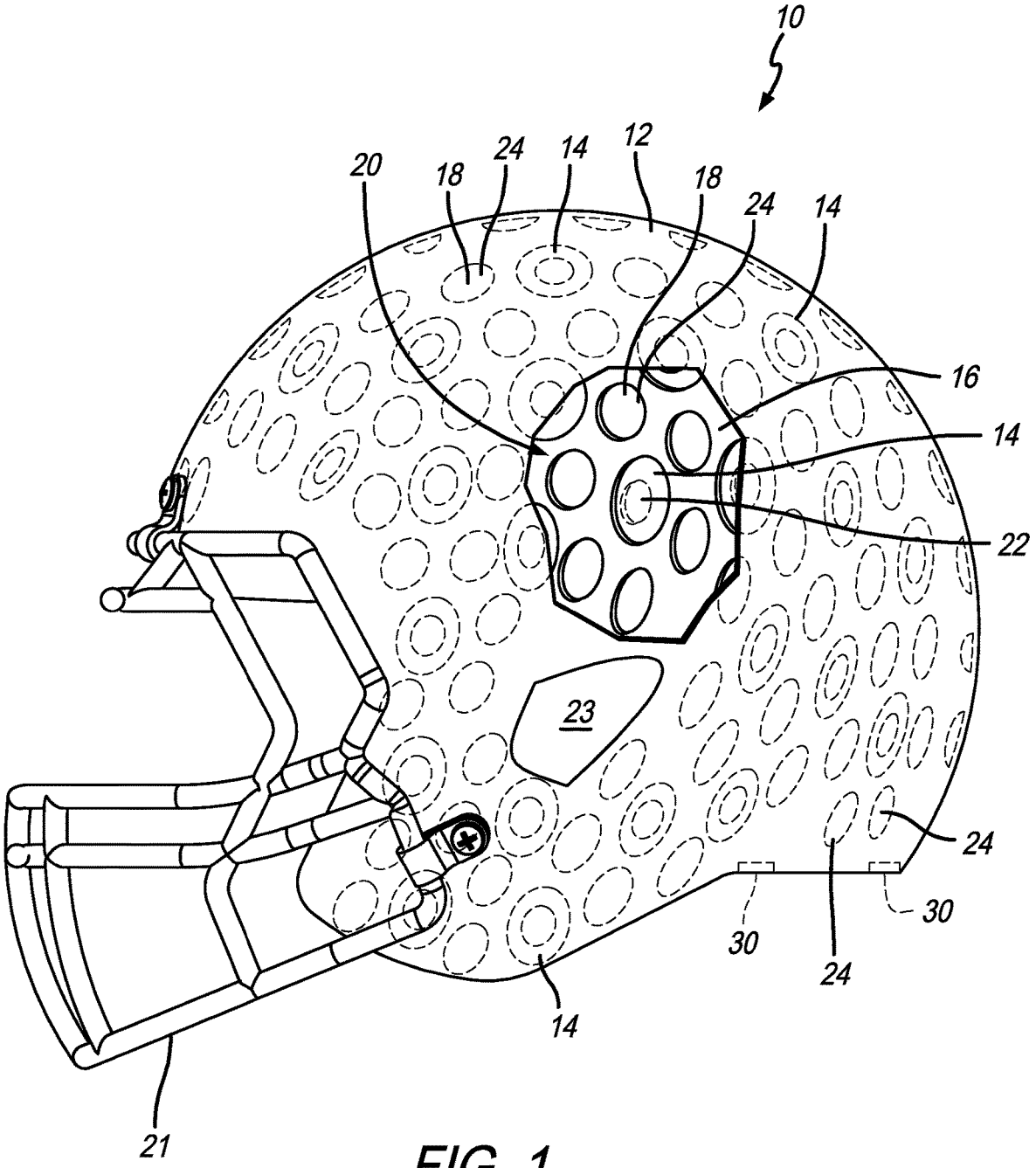
FIG. 1 is a side elevational view of a helmet with a magnetic suspension system in accordance with a preferred embodiment of the present invention.
Figure 2:
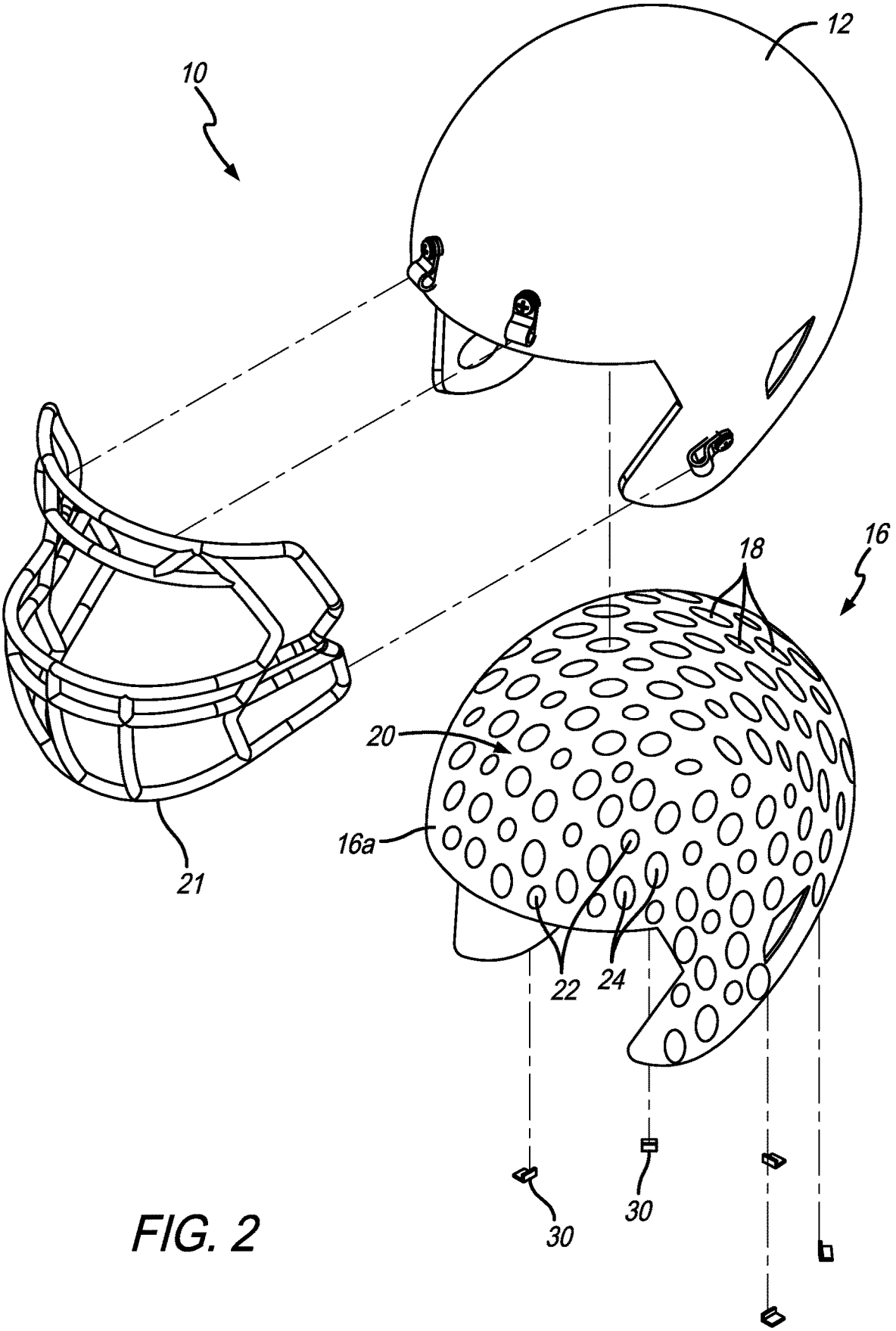
FIG. 2 is a top exploded view of the helmet of FIG. 1.
Figure 3:
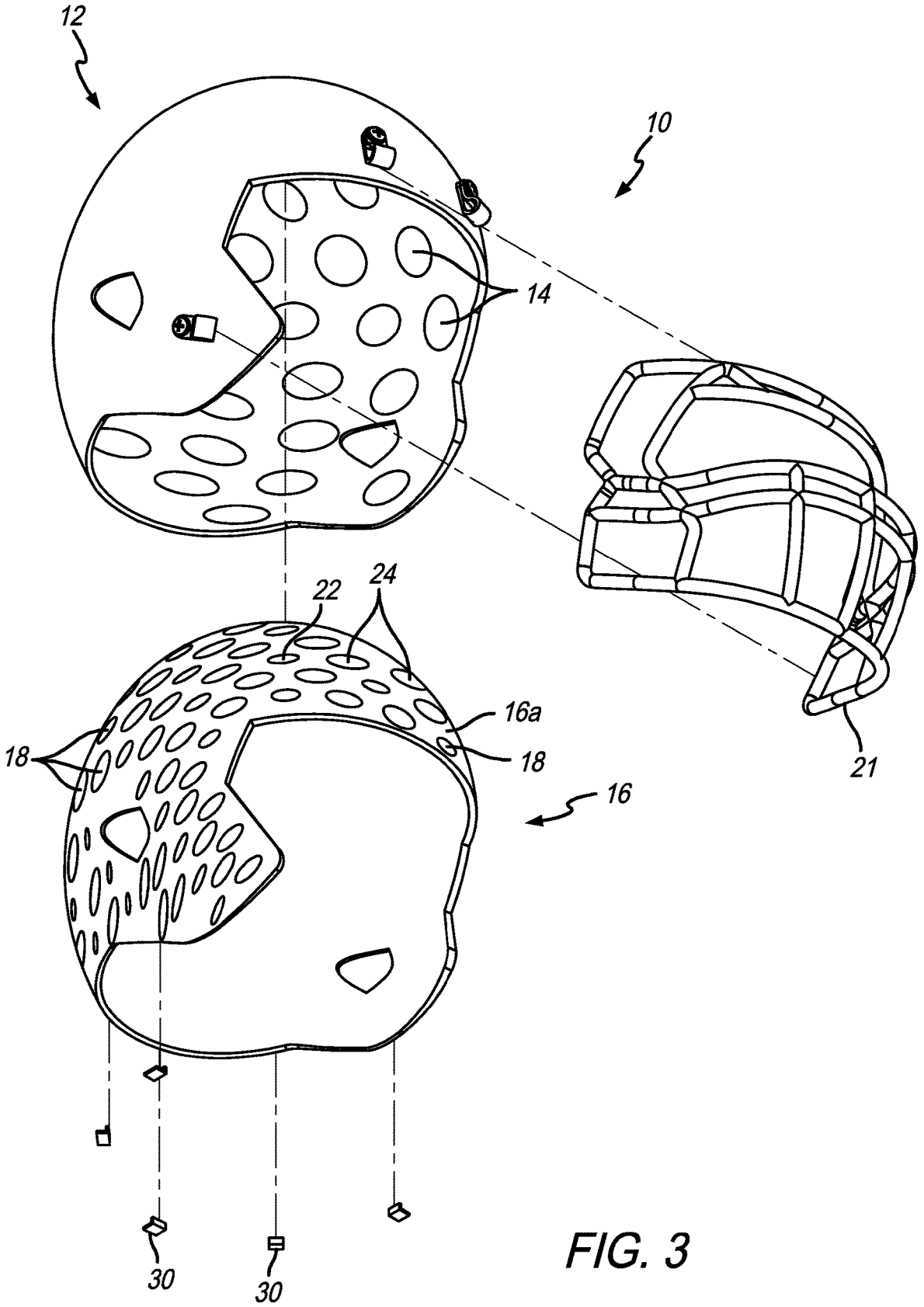
FIG. 3 is a bottom exploded view of the helmet of FIG. 1.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Figure 4:
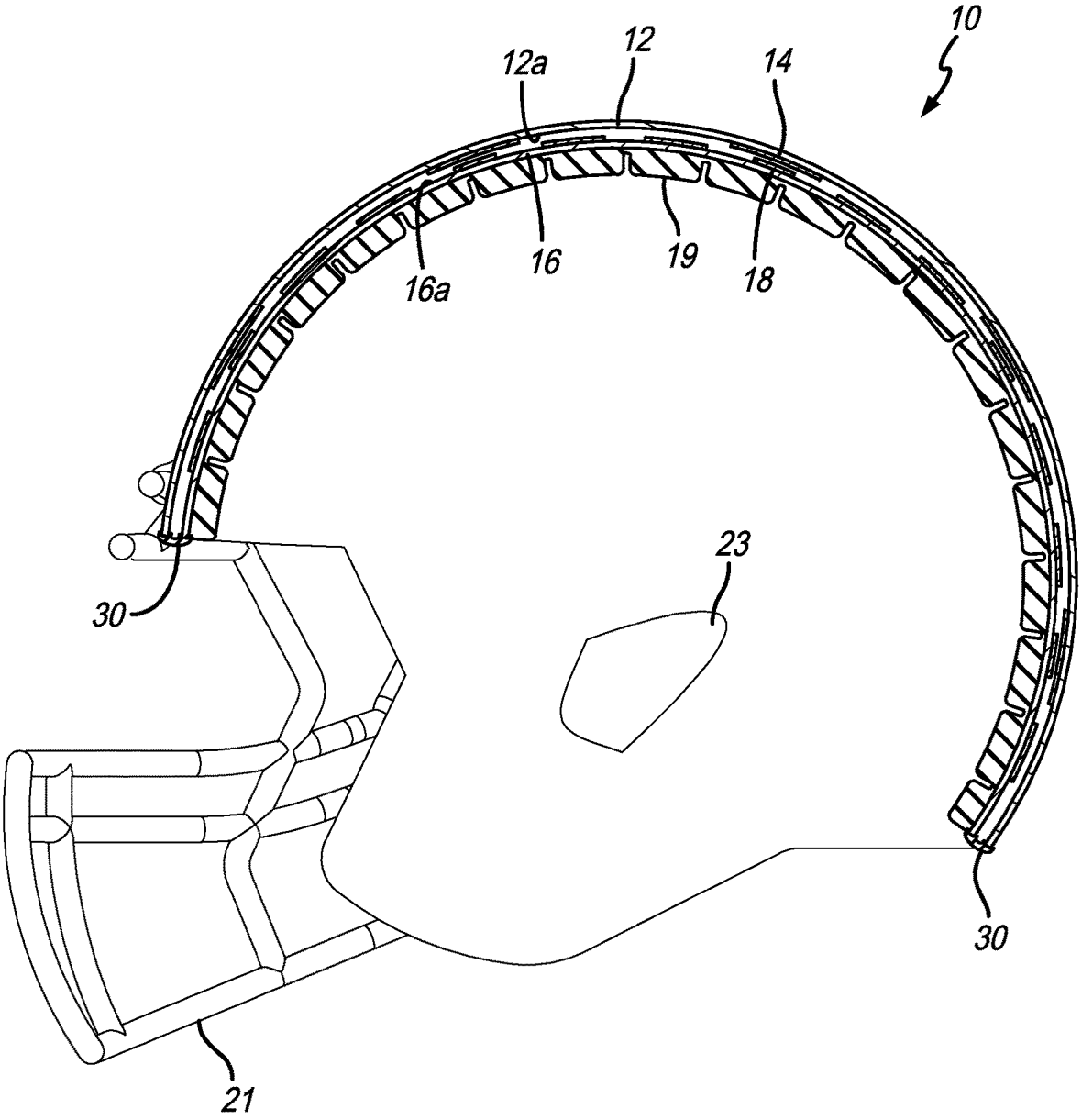
FIG. 4 is a cross-section of the helmet of FIG. 1.

Referring now to the figures, which are for purposes of illustrating the present invention and not for purposes of limiting the same, FIGS. 1-10 show a helmet 10 that includes an outer shell 12 that includes at least a first outer magnetic member 14, an inner shell 16 that includes at least a first inner magnetic member 18, and a liner or padding 19 that is secured inside the inner shell 16. In another embodiment, the padding 19 and inner shell 16 can be unitary or a single piece. It will be appreciated that the liner or padding can be any kind of liner system, pads, padding, net or the like that go inside a helmet to either protect the wearer or help secure the helmet to the wearer's head. The helmet 10 can also include a facemask 21, ear holes 23 or other components associated with a football helmet. In a preferred embodiment, the outer shell 12 includes a plurality of outer magnetic members 14 and the inner shell 16 includes a plurality of inner magnetic members 18. Preferably, the outer magnetic members 14 face inwardly and oppose the inner magnetic members 18 that face outwardly. As shown in FIG. 4, the inner magnetic members 18 are spaced from the outer magnetic members 14. Some or all of the inner magnetic members 18 are opposed to outer magnetic members 14. It will be appreciated that the magnetic members are configured such that the inner magnetic members 18 repel the outer magnetic members 14. In a preferred embodiment, the magnetic vectors of the inner and outer magnetic members 18 and 14 are generally parallel with respect to one another and are generally perpendicular to the plane of the inner or outer shell 16 or 12 at the point where attached to the inner or outer shell 16 or 12.

Figure 5A:
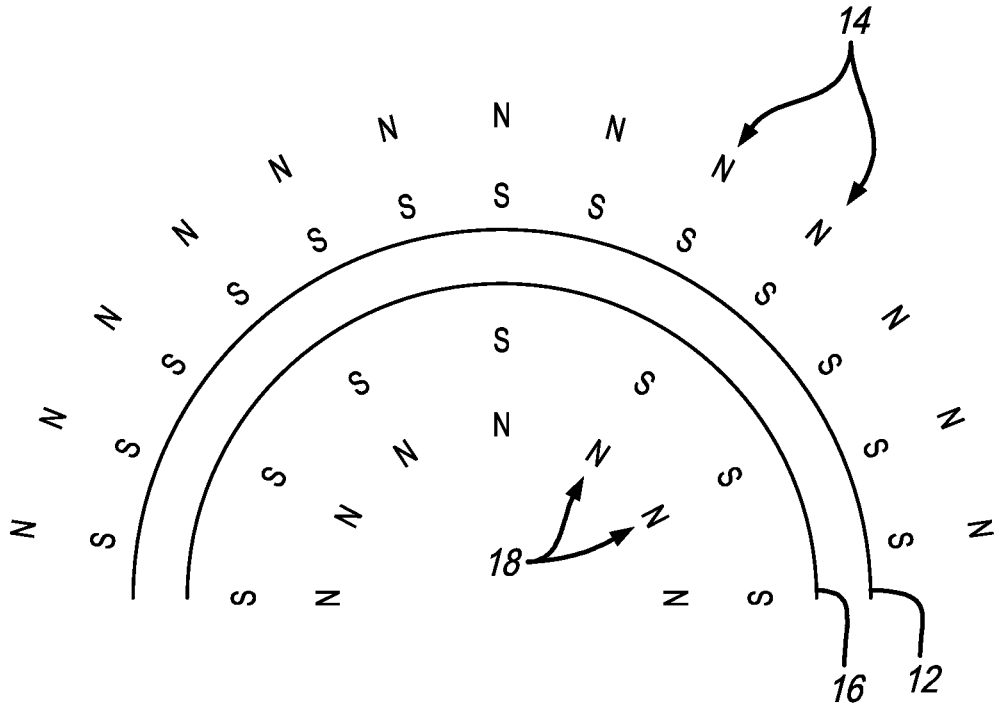
FIGS. 5A and 5B are schematic views of the helmet showing exemplary pole arrangements of the magnets.
Figure 5B:
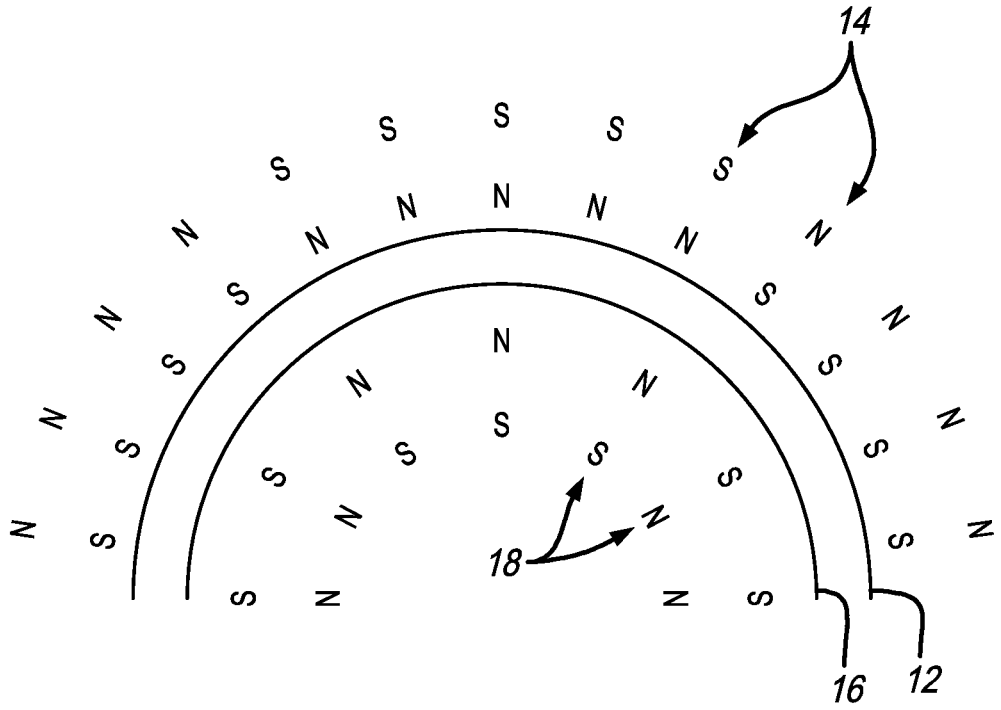
Figure 11:
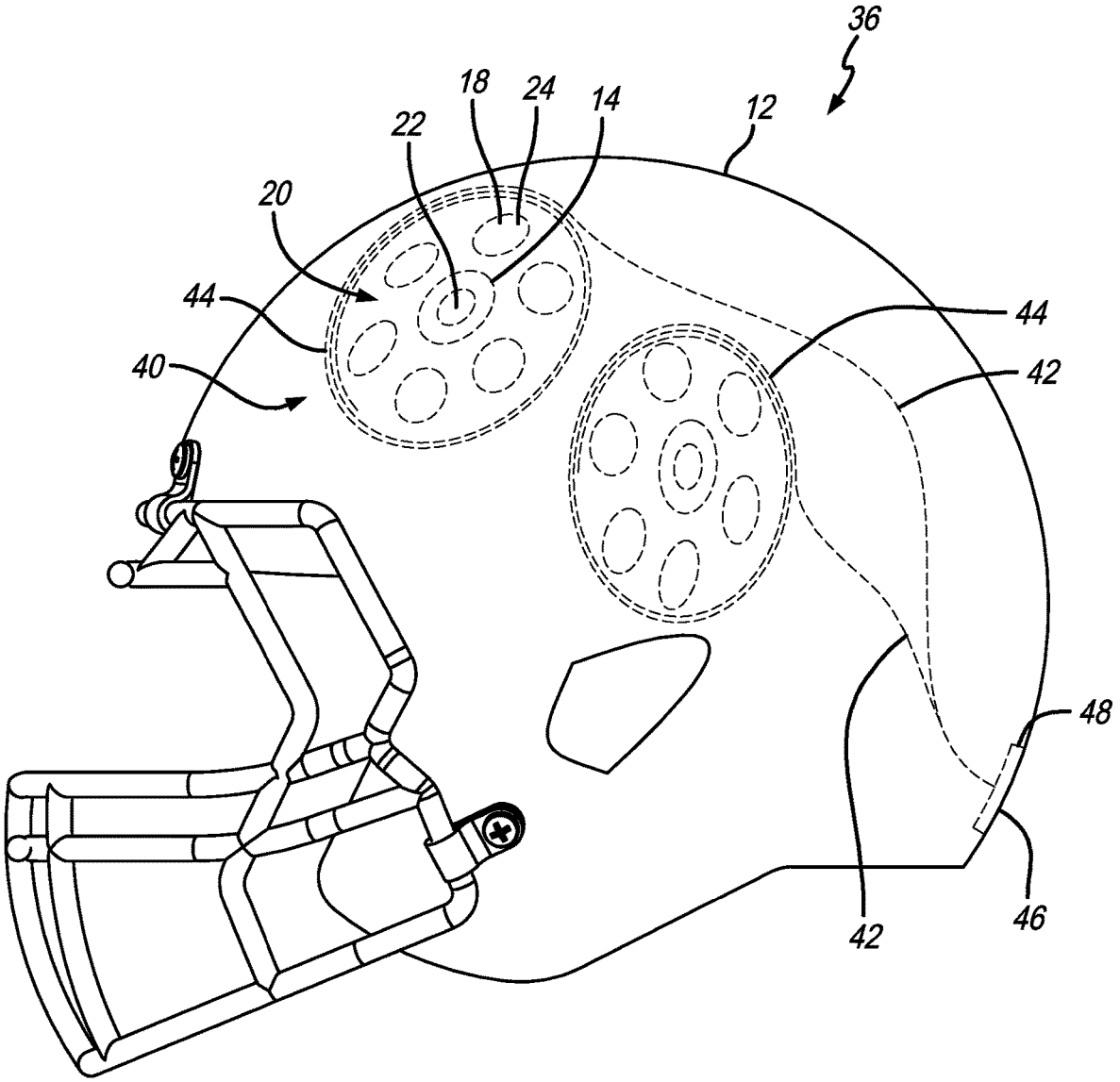
FIG. 11 is a side elevation view of a helmet that includes a magnetic suspension system that includes electromagnets in accordance with a preferred embodiment of the present invention.

The inner and outer magnetic members can be permanent or regular magnets, electromagnets or a combination thereof (see FIG. 11). In a preferred embodiment, the inner shell 16 and outer shell 12 are fabricated as bonded, permanent or blended powder magnets with a smooth surface, and are subsequently magnetized such that the magnetic vectors are uniformly in opposition. This is represented diagrammatically in FIG. 5A with magnetic north (N) and south (S) poles indicated, and for the purposes of this example, the south (S) poles are shown opposing one another. Any orientation of the opposing magnets is within the scope of the present invention. For example, as shown in FIG. 5B, the magnetic vectors can also alternate over the surface of the inner shell and outer shells 16 and 12, but remain in magnetic opposition when the inner shell 16 is properly oriented with the outer shell 12. Each set can have alternating magnetic vectors. For purposes of this example, the magnetic vectors have a north (N) opposing face toward the crown of the helmet 10 and south (S) opposing vectors along the side of the helmet 10.

Figure 6A:
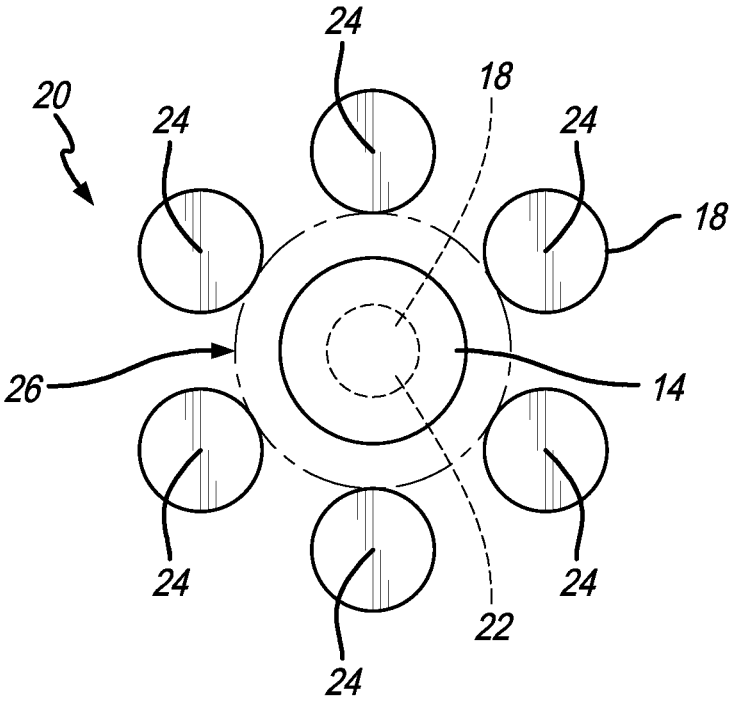
FIG. 6A is a plan view of a set of magnets used in the magnetic suspension system of the present invention.
Figure 6B:
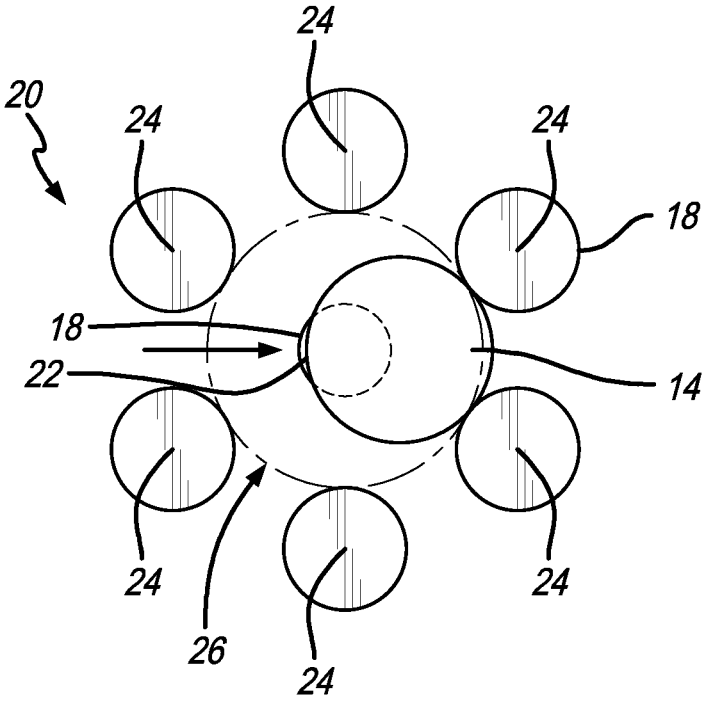
FIG. 6B is another plan view of the set of magnets used in the magnetic suspension system of the present invention with the outer magnetic member moved to the right.

In a preferred embodiment, one or both of the inner and outer magnetic members 18 and 14 are configured such that they comprise a plurality of rosettes or sets 20 of magnetic members. FIG. 6A shows a set 20 of inner magnetic members together with a single outer magnetic member 14. In a preferred embodiment, each set 20 includes a central magnetic member 22 and a plurality of surrounding magnetic members 24. The central magnetic member 22 opposes and repels one of the outer magnetic members 14. In a preferred embodiment, the central magnetic member 22 is co-axial with the opposing outer magnetic member 14 (or inner magnetic member if the set is on the outside shell). FIGS. 6A and 6B show a view of the set 20 together with the outer magnetic member 14 from outside the helmet. As a result, the central magnetic member 22 is shown in hidden lines in FIG. 6A as it is covered by outer magnetic member 14.

As discussed above, the surrounding magnetic members 24 are positioned to create a "magnetic wall" to contain the outer magnetic member 14 when lateral rotation movement occurs. This is shown in FIG. 6B. This arrangement creates a magnetic well 26 between the plurality of surrounding magnetic members 24. It will be appreciated that the central magnetic member 22 opposes and repels the opposing outer magnetic member 14 while the surrounding magnetic members 24 (that are located radially or laterally outwardly from the central magnetic member 22) contain the outer magnetic member 14 so that it cannot move outside of the well 26 in a lateral or sideways direction (see the arrow representing magnet 14 moving to the right in FIG. 6B and being contained within the well 26 by magnets 24 on the right).

In a preferred embodiment, the surrounding magnetic members 24 have a stronger magnetism than the central magnetic member 22. This can be done by providing a stronger magnetic material for the surrounding magnetic members 24 or by making the surrounding magnetic members 24 larger than the central magnetic member 22 (if they are made of the same material), as shown in FIGS. 6A and 6B. As shown in FIG. 6A, the surrounding magnetic members 24 are not opposed to any outer magnetic members. However in another embodiment, the surrounding magnetic members 24 can be opposed to an outer magnetic members (or inner magnetic member if the sets 20 are on the outside shell). It will be appreciated that the sets 20 may overlap one another. For example, as shown in FIG. 1, at least some of the surrounding magnetic members 24 of a first set can also be the surrounding magnetic members 24 of a second set.

Figure 7:
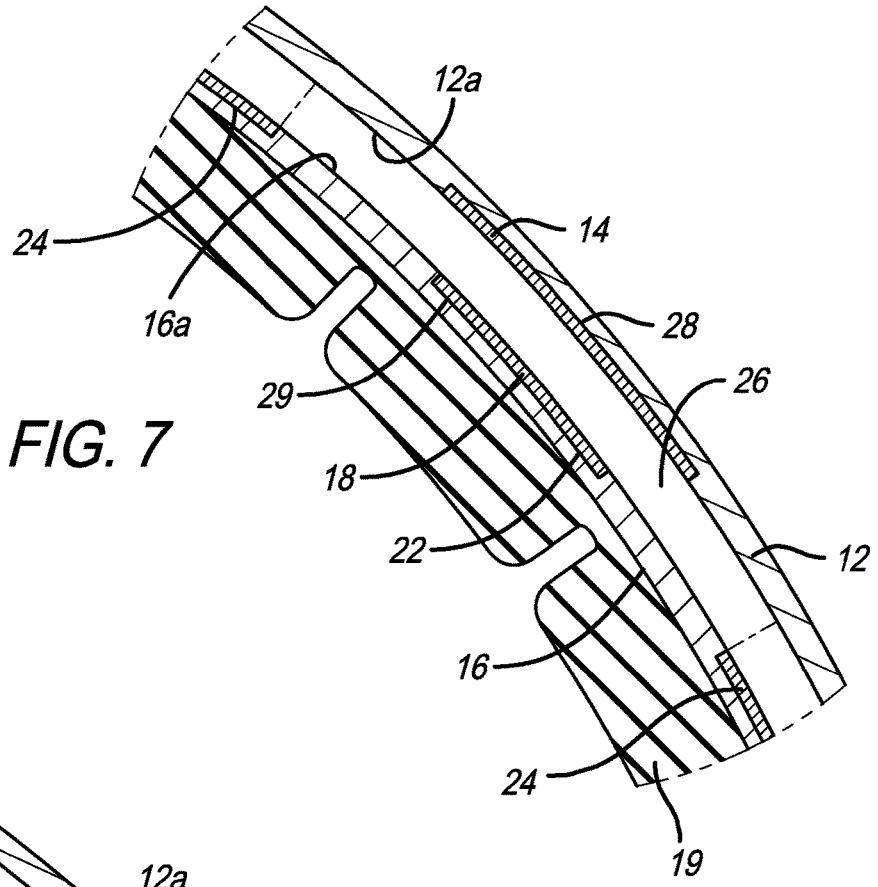
FIG. 7 is a cross-sectional view of a portion of the helmet showing magnets embedded in the inner and outer shells.
Figure 8A:
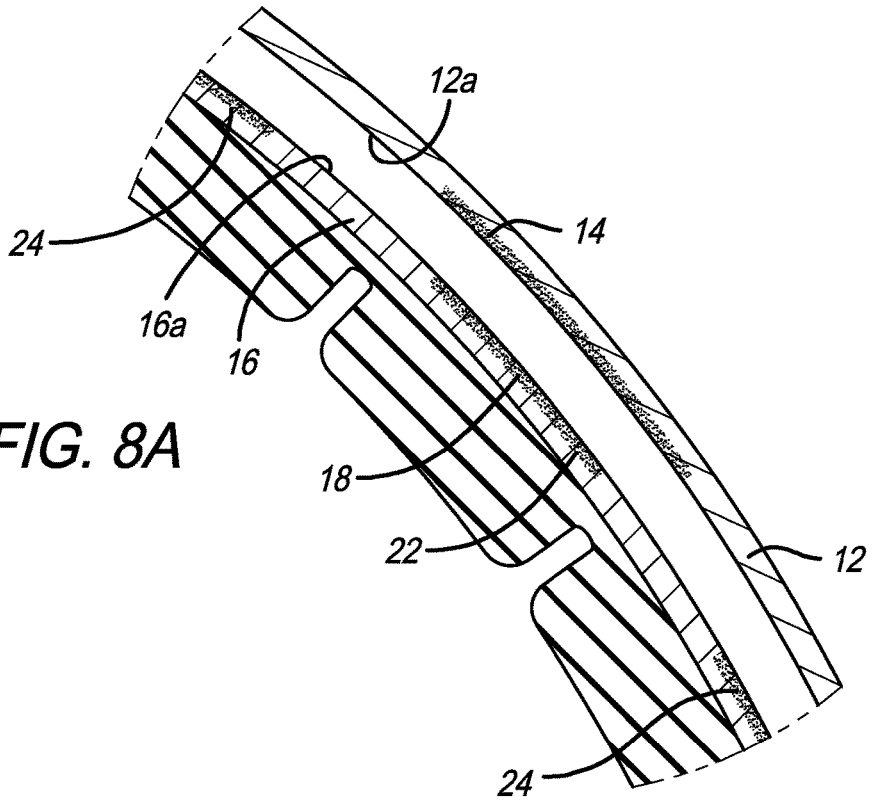
FIGS. 8A and 8B are cross-sectional views of a portion of the helmet showing powdered magnetic material embedded in the inner and outer shells.
Figure 8B:
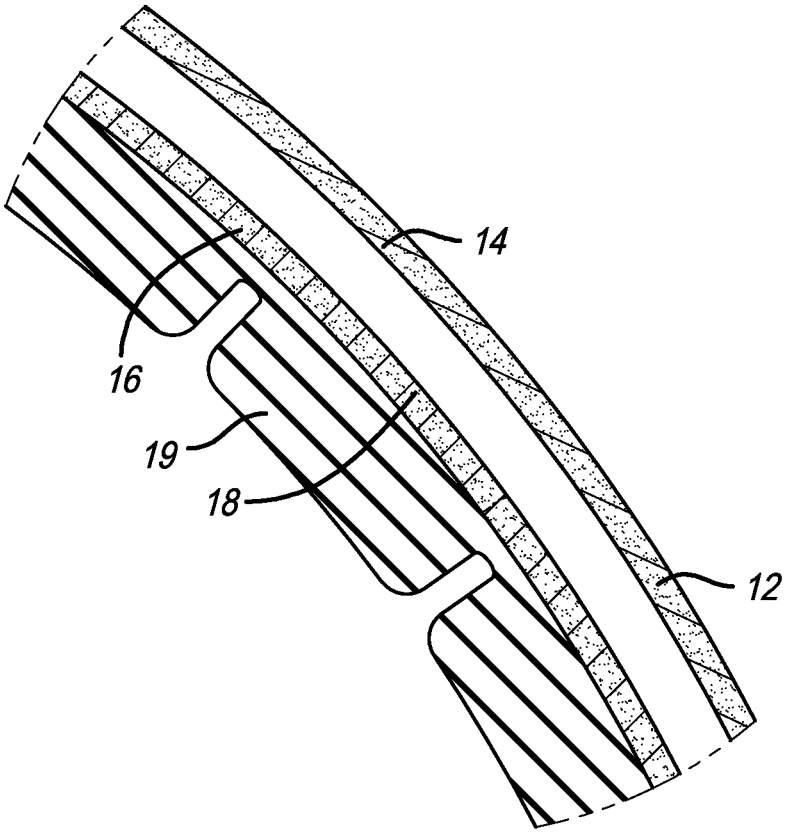

The magnetic members can be secured to or within the subject shell in any number of different ways. For example, in a preferred embodiment, as shown in FIG. 4, the outer magnetic members 14 can be bonded to an inner surface 12*a* of the outer shell 12 and the inner magnetic members 18 can be bonded to an outer surface 16*a* of the inner shell 16. In another preferred embodiment, the outer magnetic members 14 can be embedded in the outer shell 12 and the inner magnetic members 18 can be embedded in the inner shell 16. The embedded magnetic members can be exposed to an exterior surface of the inner and outer shells or can be completely embedded therein. For example, as shown in FIG. 7 in a preferred embodiment, the outer magnetic members 14 can be received and be secured in a recess 28 defined in the inner surface 12*a* of the outer shell 12 and the inner magnetic members 18 can be received in a recess 29 defined in the outer surface 16*a* of the inner shell 16. In another preferred embodiment, as shown in FIGS. 8A-8B, the inner and outer magnetic members 18 and 14 can comprise a powder that is embedded in the inner or outer shell 12, 16. FIG. 8A shows powder only disposed in some areas to create the magnetic members. In another embodiment, as shown in FIG. 8B, powder is disposed throughout the inner and/or outer shells 16 and 12. In this embodiment, the inner shell 12 is magnetized and the outer shell 16 is magnetized. This essentially makes the inner shell 12 the inner magnetic member 14 and the outer shell 16 the outer magnetic member. In another embodiment, separate magnets (e.g., disc magnets) can be added to the magnetized (via powder) inner and outer shells to enhance the magnetic suspension effect. For example, a one or more sets 20 can be added to the inner or outer shell with an opposing single magnet on the other of the inner or outer shell. The sets can be added in key impact locations. For example, in a football helmet the sets can be added to the front, back, left and right sides and crown of the helmet. In another embodiment, one of the inner or outer shell 16 or 12 can include powder therein and the other of the inner or outer shell 16 or 12 can include separate magnets (e.g., disc magnets) thereon.

In another embodiment, the magnetic powder can be dispersed throughout the inner and outer shells (as shown in FIG. 8B), and then certain areas can be magnetized thereafter to create the sets 20 or other arrangement of magnets, e.g., wells and walls. The strategic magnetization of powder in different areas of the shells allows for the ability to magnetize and create inner and outer magnetic members as desired. For example, instead of a plurality (i.e., 2-6 disc magnets) surrounding a central magnet to create a set, an actual circular pattern of powder embedded in the inner or outer shell can create the surrounding magnetic members that define the well and surround a central magnetic member comprised of magnetized powder.

Figure 9:
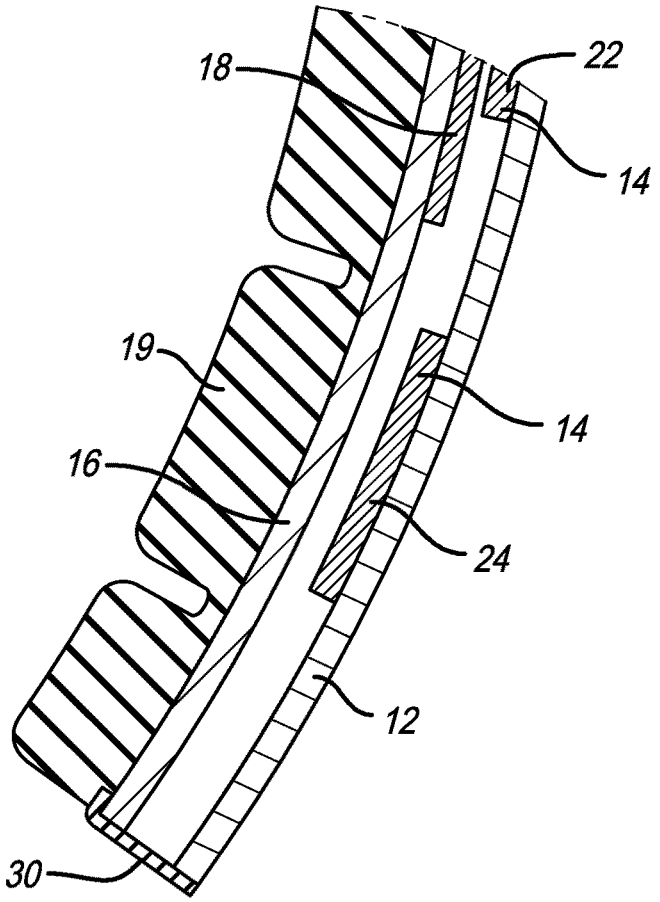
FIG. 9 is a cross-sectional view of a portion of the helmet showing an exemplary connection member.
Figure 10:
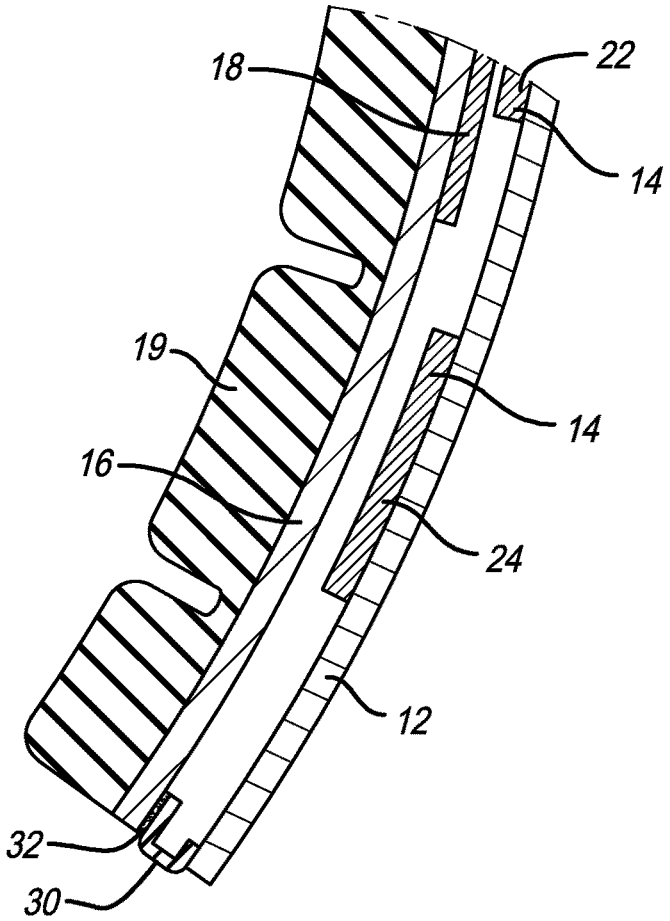
FIG. 10 is a cross-sectional view of a portion of the helmet showing another exemplary connection member.

As shown in FIGS. 9-10, in a preferred embodiment, the helmet includes at least one and preferably a plurality of connection members 30 that secure the inner shell 16 to the outer shell 12. Preferably, the connection members 30 are comprised of an elastic material, such that the outer shell 12 can move with respect to the inner shell 16. The material can be rubber or another elastomer (e.g., a bungee cord). The connection members 30 can be a strip of material that extends between the outer shell 12 and the inner shell 16 and is secured thereto. A permanent connection can be provided or a temporary connection so that the outer shell 12 can be separated from the inner shell 16. In the temporary connection, the strip of material can be adhered to one of the inner or outer shell and then secured to the other of the inner or outer shell by VELCRO™ (hook and loop fastener) 32, snap, button, lever or other connection device. In another embodiment, a single connection member can extend all the way around the bottom edges, bottom rims or outer periphery of the inner and outer shells 18 and 12. It will be appreciated that FIGS. 9-10 also show an embodiment where the set of magnets are on the outer shell 12 (including the central magnetic member 22 and surrounding magnetic members 24) and the single magnet (inner magnet member 18) is included on the inner shell 16.

FIG. 11 shows an embodiment of the invention where at least some of the magnets are electromagnets. FIG. 11 shows the helmet 36 with the outer shell 12 with an electromagnetic coil system 40 adjacent to the rosettes or sets 20 of magnets. The embodiment includes wires 42 for electrical communication between the coils 44 and a controller 46 that is located in a pocket or recess 48 in the helmet at the base of the shell. The controller 46 can include a computer processing electronic impact measurement chip powered by lithium batteries and the required sensors (e.g., accelerometer sensors) for sensing a predetermined impact level and activating the electromagnets. Only two sets 20 of magnets and accompanying electromagnets are shown in FIG. 11. However, it will be appreciated that more can be included, similar to the embodiment above. The electromagnets can be on one side (inner or outer shell) and the permanent magnets can be on the other. In another embodiment the electromagnets can be on both the inner and outer shell. In another embodiment, the electromagnets can alternate between the inner and outer shell with the permanent magnets. In another embodiment, the electromagnets can be coupled with the permanent magnets to increase the strength when higher force impacts are detected.

It will be appreciated that alternative embodiments are within the scope of the present invention. For example, a single central magnet can be positioned at the crown of the inner or outer shell that is opposed to a set of magnetic plates that form a magnetic well. In another embodiment sets 20 that oppose a single magnetic member can be provided on the inner and outer shells. In other words, a set 20 on the outer shell 12 can oppose a single inner magnetic member 18 and can be positioned adjacent a set 20 on the inner shell 18 that opposes a single outer magnetic member 14.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used. Further, any specific materials noted herein are only examples: alternative implementations may employ differing materials.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A helmet comprising:

an outer shell, an inner liner, wherein the outer shell is connected to the inner liner, and wherein the outer shell is movable with respect to the inner liner, and a plurality of magnetic assemblies, wherein each magnetic assembly of the plurality of magnetic assemblies includes a set of magnetic members associated with one of the outer shell and inner liner and a corresponding opposing magnetic member associated with the other of the outer shell and inner liner, wherein each set of magnetic members includes a central magnetic member and a plurality of magnetic elements arranged concentrically around the central magnetic member, wherein within each magnetic assembly, the central magnetic member opposes and is spaced apart from the corresponding opposing magnetic member.

2. The helmet of claim 1 wherein the sets of magnetic members are bonded to an inner surface of the outer shell, and the opposing magnetic members are bonded to an outer surface of the inner liner or wherein the sets of magnetic members are bonded to the outer surface of the inner liner and the opposing magnetic members are bonded to the inner surface of the outer shell.

3. The helmet of claim 1 wherein the sets of magnetic members are embedded in the outer shell and the opposing magnetic members are embedded in the inner liner or wherein the sets of magnetic members are embedded in the inner liner and the opposing magnetic members are embedded in the outer shell.

4. The helmet of claim 3 wherein at least one of the sets of magnetic members and the opposing magnetic members comprises a powder.

5. The helmet of claim 1 wherein the inner liner is connected to the outer shell by at least a first connection member.

6. The helmet of claim 5 wherein the first connection member comprises an elastic material, such that the outer shell can move with respect to the inner liner.

7. The helmet of claim 1 wherein within each set of magnetic members, the plurality of magnetic elements has a stronger magnetism than the central magnetic member.

8. The helmet of claim 7 wherein for each magnetic assembly, the plurality of magnetic elements are not opposed to the corresponding opposing magnetic member when the outer shell has not moved with respect to the inner liner.

9. The helmet of claim 1 wherein at least one of the sets of magnetic members and the opposing magnetic members are electromagnets.

10. The helmet of claim 1 wherein said plurality of magnetic elements defines an inner perimeter, wherein each opposing magnetic member defines a central axis and an outer perimeter, and wherein the outer perimeter does not overlap the inner perimeter in an axial direction when the outer shell has not moved with respect to the inner liner.

11. The helmet of claim 1 wherein within each of the plurality of magnetic assemblies, the opposing magnetic member defines a central axis and the central magnetic member is coaxial with the opposing magnetic member.

12. The helmet of claim 11 wherein the opposing magnetic member has a larger diameter than the central magnetic member.

13. The helmet of claim 1 further comprising padding secured inside the inner liner.

* * * * *